United States Patent [19]

Takada

[11] 4,086,041

[45] Apr. 25, 1978

[54] ROTARY COMPRESSOR COMPRISING IMPROVED ROTOR LUBRICATION SYSTEM

[75] Inventor: Haruhiko Takada, Konan, Japan

[73] Assignee: Diesel Kiki Co., Ltd., Tokyo, Japan

[21] Appl. No.: 711,337

[22] Filed: Aug. 4, 1976

[30] Foreign Application Priority Data

Aug. 5, 1975 Japan ..... 50-108888[U]

[51] Int. Cl.[2] ..... F01C 21/04; F01C 21/12; F04B 49/02; F04C 29/02

[52] U.S. Cl. ..... 418/84; 418/93; 418/100; 417/295

[58] Field of Search ..... 418/84, 87, 91–94, 418/97–100; 417/295

[56] References Cited

U.S. PATENT DOCUMENTS

| | | | |
|---|---|---|---|
| 1,352,750 | 9/1920 | Jackson | 418/93 |
| 2,827,226 | 3/1958 | McCormack | 418/93 |
| 3,072,319 | 1/1963 | Cox et al. | 417/295 |
| 3,258,198 | 6/1966 | Harlin | 418/94 |
| 3,582,233 | 6/1971 | Bloom | 418/100 |

*Primary Examiner*—John J. Vrablik
*Attorney, Agent, or Firm*—Frank J. Jordan

[57] ABSTRACT

A rotor is eccentrically mounted in a bore of a housing and formed with radial slots in which vanes are slidably retained. A lubricant passageway leads from an oil sump through the radially inner portions of the slots to a fluid inlet, the oil sump communicating with a fluid outlet. The high pressure in the outlet forces oil through the lubricant passageway to lubricate the vanes and urge the vanes into sealing engagement with the inner wall of the bore. Oil sucked from the inlet into the bore lubricates the outer ends of the vanes and is recovered at the outlet and returned to the oil sump. A check valve at the inlet closes when the compressor is stopped to prevent discharge of fluid and oil out the inlet. An equalizing valve acting integrally with the check valve connects the inlet to the outlet when the compressor is stopped to prevent oil from filling the inlet.

9 Claims, 3 Drawing Figures

ROTARY COMPRESSOR COMPRISING IMPROVED ROTOR LUBRICATION SYSTEM

BACKGROUND OF THE INVENTION

The present invention relates to a rotary compressor which may be advantageously employed in an air conditioning system of an automotive vehicle for compressing a refrigerant fluid.

Rotary compressors are well known in the art which comprise a housing formed with a bore, fluid inlets and outlets communicating with the bore and a rotor mounted in the bore in such a manner that rotation thereof causes a working fluid such as a refrigerant to be compressively displaced from the inlet to the outlet. The rotor is typically provided with radial slots and vanes which are slidably retained in the slots and urged into sealing engagement with the inner wall of the bore. The rotor is eccentrically or similarly disposed in the bore in such a manner that upon rotation of the rotor the vanes divide the bore into fluid chambers of progressively varying volume. The compressor is designed so that the fluid chambers increase in volume in the vicinity of the inlet and decrease in volume in the vicinity of the outlet so that the fluid is sucked into the fluid chambers through the inlet and discharged therefrom through the outlet at elevated pressure. Due to the sealing effect of the vanes the compressor operates on the positive displacement principle.

A unique method has recently been devised to lubricate the rotor without the provision of a separate oil pump. An oil sump is provided below the compressor housing which communicates with the fluid outlet. In this manner, the oil in the oil sump is subjected to the output pressure of the fluid. An oil passageway leads from the oil sump through the inner portion of the rotor to the fluid inlet in such a manner that oil is forced from the pressurized oil sump through the interior or the rotor to the low pressure fluid inlet.

The rotor comprises a drive shaft and a rotor body fixed to the shaft, the vane slots being formed in the rotor body. The oil passageway leads through the radially inner portions of the vane slots between the vanes and the shaft so that the pressurized oil not only lubricates the areas of sliding contact between the vanes and the walls of the respective slots but also urges the vanes radially outwardly into sealing engagement with the inner wall of the bore.

The oil is sucked along with the working fluid into the fluid chambers in the bore and lubricates the areas of sliding contact between the outer ends of the vanes and the wall of the bore. At the fluid outlet, the oil is separated from the working fluid and returned to the oil sump.

Although this basic design provides extremely efficient compressor operation and enables a substantial reduction in the number of component parts, a problem is encountered when the compressor is stopped. Even after the rotor movement is stopped, a substantial pressure difference exists between the fluid inlet and outlet which causes oil to flow through the oil passageway. Although the inlet and outlet pressures eventually reach equilibrium, the oil which flows after the compressor is stopped is of considerable volume and often fills the fluid inlet. As a result, when the compressor is again started, a hydraulic shock or "oil hammer" is produced which is capable of damaging the compressor.

SUMMARY OF THE INVENTION

It is an object of the present invention to provide a rotary compressor of the type described above in which the problem of hydraulic shock is eliminated.

It is another object of the present invention to provide a rotary compressor comprising means for preventing flow of lubricating oil after stopping of the compressor.

It is another object of the present invention to provide a rotary compressor comprising integral valve means for automatically blocking a fluid inlet and connecting the fluid inlet to a fluid outlet to equalize the pressure between the inlet and outlet when the compressor is stopped.

It is another object of the present invention to provide a generally improved rotary compressor.

Other objects, together with the foregoing, are attained in the embodiment of the present invention described in the following description and shown in the accompanying drawings.

DESCRIPTION OF THE PREFERRED EMBODIMENT

Figure 1:
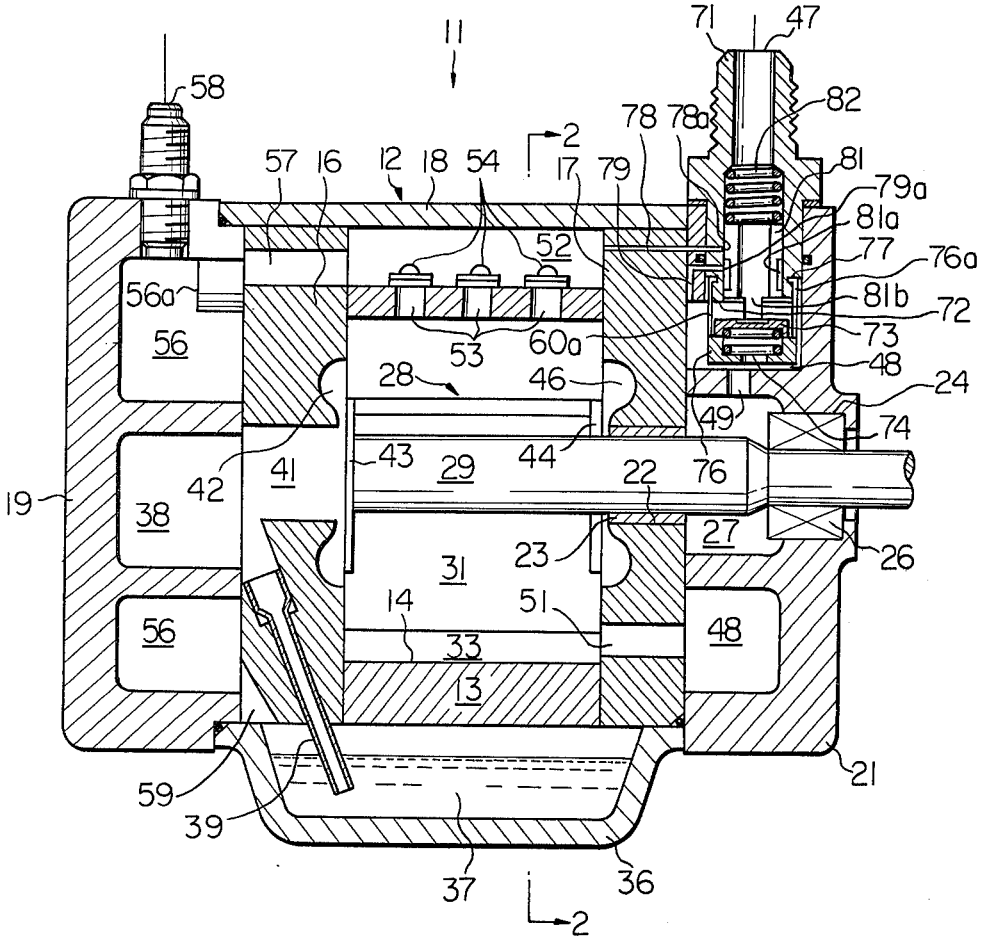
FIG. 1 is a longitudinal sectional view of a rotary compressor embodying the present invention shown in an operating condition.

While the rotary compressor of the present invention is susceptible of numerous physical embodiments, depending upon the environment and requirements of use, substantial numbers of the herein shown and described embodiment have been made, tested and used, and all have performed in an eminently satisfactory manner.

Referring now to the drawing, a rotary compressor 11 embodying the present invention comprises a housing which is generally designated as 12. The housing 12 comprises a cylinder 13 which is formed with a bore 14. The left and right ends (as viewed in FIG. 1) of the cylinder 13 are closed by end plates 16 and 17 respectively. The assembly comprising the cylinder 13 and end plates 16 and 17 is supported within a generally cylindrical shell 18. A left end cover 19 and a right end cover 21 are fixed to the end plates 16 and 17 respectively by bolts which are not shown.

The end plate 17 is formed with an opening 22 in which is fitted a rolling contact bearing 23. The bearing 23 is designed with spaces between the rolling elements (not shown) thereof in such a manner that oil may pass longitudinally therethrough.

The right end cover 21 is similarly formed with an opening 24 in which is fitted a bearing 26. Although the bearing 26 may be similar to the bearing 23, the bearing 26 is further provided with an oil seal (not shown) to prevent passage of oil therethrough. The right end plate 21 is further formed with a low pressure oil chamber 27 communicating with the bearings 23 and 26.

A rotor which is generally designated as 28 comprises a drive shaft 29 which is rotatably supported by the bearings 23 and 26. A rotor body 31 is fixed to the shaft 29 for unitary rotation and is formed with radial slots 32 which are shown most clearly in FIG. 2. Vanes 33 are radially slidingly retained in the slots 32 respectively and engage with the inner wall (not designated) of the bore 14.

Although any number of slots 32 and vanes 33 may be provided, the number shown is four each which are circumferentially spaced at intervals of ninety degrees. The cylinder 13, rotor body 31, slots 32 and vanes 33 are coextensive in such a manner that the rotor body 31 and vanes 33 sealingly engage with the end walls 16 and 17. Although various configurations may be provided for the cross-sections of the bore 14 and rotor body 31, the compressor 11 operates in an extremely effective manner if said sections are circular, with the diameter of the bore 14 being greater than the diameter of the rotor body 31. The rotor body 31 is furthermore coaxial with the shaft 29 and sealingly tangent to the inner wall of the bore 14 at the uppermost point thereof, designated as 34. It is clear that the openings 22 and 24 in the end plate 17 and end cover 21 as well as the bearings 23 and 26 and shaft 29 are mutually coaxial and are eccentric relative to the central axis of the bore 14.

A lubricant reservoir or oil sump 36 is mounted to the bottom of the housing 12 and is filled with oil up to a level 37. The left end cover 19 is formed with a high pressure oil chamber 38 which communicates with the oil sump 36 below the oil level 37 through a tube 39. The end plate 16 is formed with an opening 41 which provides communication between the high pressure oil chamber 38 and the left end of the rotor 28 as viewed in FIG. 1. The right face of the left end plate 16 is formed with an annular recess 42 coaxial with the opening 41 and the shaft 29. The left face of the rotor body 31 is formed with a circular recess 43 conjugate to the recess 42. In this manner, the radially inner portions of the slots 32 in the rotor body 31 communicate with the oil sump 36 through the recesses 43 and 42, the opening 41, the high pressure oil chamber 38 and the tube 39.

The right face of the rotor body 31 is formed with an annular recess 44 and the left face of the end plate 17 is formed with a conjugate annular recess 46. In this manner, the slots 32 communicate with the low pressure oil chamber 27 through the recesses 44 and 46 and the bearing 23.

Where the compressor 11 is employed to circulate a refrigerant fluid in an automotive air conditioning system, a fluid inlet port 47 is connected to an evaporator unit (not shown). The inlet port 47 leads as will be described in detail below into an annular inlet chamber 48 formed in the end cover 21. The low pressure chamber 27 communicates with the inlet chamber 48 through an opening 49. As best viewed in FIG. 2, a generally crescent shaped inlet orifice 51 leads from the inlet chamber 48 into the bore 14. The upper portion of the cylinder 13 is cut away to form an outlet passageway 52, which communicates with the bore 14 through outlet orifices 53. Check valves 54 are provided at the outlet orifices 53 respectively to prevent reverse flow through the compressor 11. The left end cover 19 is formed with an annular outlet chamber 56 which communicates with the outlet passageway 52 through a passageway 57 formed through the end plate 16, which constitutes an extension of the outlet passageway 52, and an oil separator 56*a*. The outlet chamber 56 is connected through an outlet port 58 to a condenser (not shown) of the air conditioning system and communicates with the oil sump 36 through a passageway 59 formed through the end wall 16.

The basic compressor 11 described thus far operates as follows. The shaft 29 is connected to a crankshaft of the automobile engine through an electromagnetic clutch (not shown). To operate the air conditioner and thereby the compressor 11, the electromagnetic clutch is engaged to rotatably drive the shaft 29 counterclockwise in FIG. 2.

Figure 2:
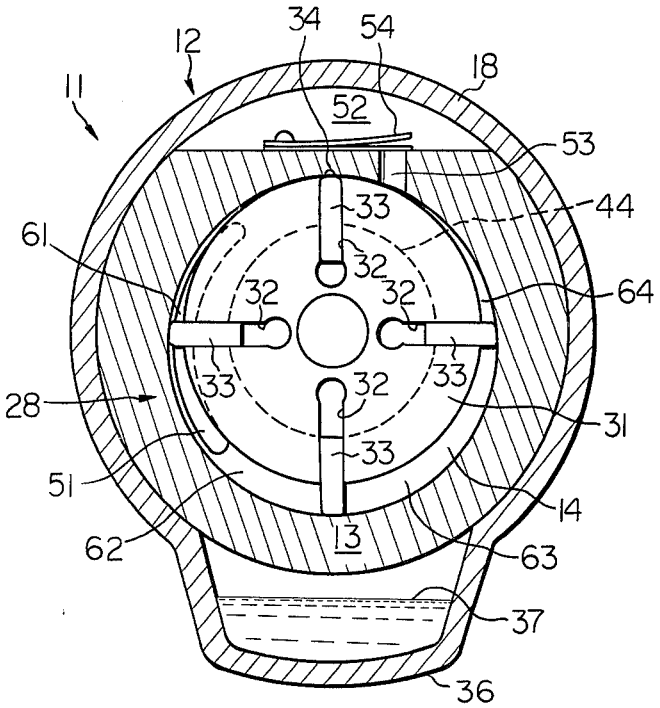
FIG. 2 is a side sectional view of the compressor shown in FIG. 1 taken on a line 2—2.

As shown in FIG. 2, the vanes 33 in conjunction with the rotor body 31 and the inner wall of the bore 14 divide the space between the rotor body 31 and inner wall into four fluid chambers shown as occupying positions 61, 62, 63 and 64. It will be noticed that the volumes of the fluid chambers in positions 61 and 64 are small and the volumes of the fluid chambers in positions 62 and 63 are larger. The fluid chamber in position 61 is located in the vicinity of the inlet orifice 51 whereas the fluid chamber in position 64 is located in the vicinity of the outlet orifices 53. Counterclockwise rotation of the rotor 28 causes the fluid chamber in position 61 to progressively occupy the positions 62, 63 and 64.

In this manner, the volume of each fluid chamber increases while the fluid chamber is in communication with the inlet orifice 51 thereby sucking working fluid or refrigerant thereinto through the inlet port 47 and inlet chamber 48. This creates a partial vacuum or low absolute pressure in the inlet chamber 48.

As the trailing vane 33 of each fluid chamber passes the counterclockwise end of the inlet orifice 51, the fluid chamber is sealed. As each fluid chamber passes through position 63 and approaches position 64, the volume thereof decreases thereby compressing the working fluid therein. As the leading vane 33 of each fluid chamber passes the outlet orifices 53, the fluid is discharged therefrom through the outlet chamber 56 and the outlet port 58 to the condenser. As the trailing vane 33 of each fluid chamber approaches the outlet orifices 53, the volume of the fluid chamber is extremely low and the working fluid is forced out through the outlet orifices 53. With the rotor body 31 sealingly engaging with the wall of the bore 14 at 34, each fluid chamber in the vicinity of the outlet orifices 53 is defined between the seal point 34 and the trailing vane 33 of the fluid chamber, so that the volume of the fluid chamber is extremely low. The pressure in the outlet chamber 56 is quite high due to the compressor action.

The rotor 28 and bearings 23 and 26 are lubricated as follows. Since the pressure in the outlet chamber 56 is high and is applied to the oil sump 36 through the passageway 59, the pressure in the oil sump 36 is high. Conversely, the pressure in the inlet chamber 48 is low. This pressure difference causes oil from the oil sump 36 to flow into the low pressure oil chamber 27, which communicates with the inlet chamber 48 through the opening 49, through the tube 39, low pressure oil chamber 38, grooves 42 and 43, slots 32 in the rotor body 31, grooves 44 and 46 and bearing 23. This pressurized oil in the radially inner portions of the slots 32 serves the dual function of lubricating the sliding contact areas of the vanes 33 and slots 32 and urging the vanes 33 radially outwardly into sealing engagement with the inner wall of the bore 14. The bearing 23 is lubricated by the oil passing therethrough and the bearing 26 is lubricated by the oil in the low pressure oil chamber 27.

The oil is sucked from the low pressure oil chamber 27 through the opening 49, inlet chamber 48 and inlet orifice 51 into the bore 14 where it serves to lubricate the sliding contact areas of the outer ends of the vanes 33 and the inner wall of the bore 14. The oil is discharged along with the working fluid through the outlet orifices 53 and enters the oil separator 56*a*. The oil is removed from the working fluid by the oil separator 56*a* and is returned to the oil sump 36 through the outlet chamber 56 and passageway 59. The working fluid, with the oil removed, is pumped out of the compressor 11 through the outlet port 58 to the condenser.

With the basic compressor 11 described thus far, a problem exists when the compressor 11 is stopped after a period of operation. As mentioned above, reverse flow through the compressor 11 is prevented by means of the check valves 54. Thus, even with the rotor 28 stationary, the pressure in the outlet chamber 56 and thereby the oil sump 36 is higher than that in the inlet chamber 48. Although pressure equilibrium is eventually attained due to fluid flow through the external refrigerant circuit, the pressure unbalance persists for a considerable period of time. As a result, the flow of oil continues from the oil sump 36 into the low pressure oil chamber 27 through the rotor 28. Since the compressor 11 is not in operation, the oil cannot be pumped through the bore 14 to the oil separator 56*a* and fills up the low pressure oil chamber 27. Depending upon the flow resistance of the external refrigerant circuit and other factors, the oil may overflow from the low pressure oil chamber 27 into the inlet chamber 48 through the opening 49 and may even enter the bore 14 through the inlet orifice 51. As a result, when the compressor 11 is restarted, a hydraulic shock will occur which may cause serious damage to the compressor 11.

In order to eliminate this problem, the present invention provides a bored valve body 71 which is screwed into the right end cover 21, the external end of the valve body 71 constituting the inlet port 47. A check valve seat 72 is formed at the inner end of the valve body 71 and a check valve element 73 is urged by a check valve compression spring 74 upwardly into sealing engagement with the check valve seat 72. A check valve spring retainer 76 is formed with legs 76*a* and clipped to the lower end of the valve body 71 through engagement of the legs 76*a* in an annular groove 77 formed in the valve body 71. The check valve spring 74 is normally retained in a preloaded state between the retainer 76 and the check valve element 73. The check valve element 73 serves to control communication between the inlet port 47 and the inlet chamber 48.

A first equalizing passageway 78 leads from the outlet passageway 52 through the end plate 17 and the wall of the valve body 71 to an orifice 78*a* thereof opening into the bore of the valve body 71. A second equalizing passageway 79 leads from an orifice 79*a* thereof opening into the bore of the valve body 71 into the inlet chamber 48. A bored equalizing valve element 81 in the form of a sleeve is sealingly slidable in the bore of the valve body 71 and is formed with an elongated annular groove 81*a* which is adapted to align with the orifices 78*a* and 79*a* connect the equalizing passageways 78 and 79 together. The lower end of the equalizing valve element 81 is formed with a projection 81*b* for abutting engagement with the check valve element 73. An equalizing valve compression spring 82 urges the equalizing valve element 81 downwardly into engagement with the check valve element 73 so that the valve elements 73 and 81 move in a unitary manner. The spring 74 is stronger than the spring 82.

The lower face of the check valve element 73 is exposed to the pressure in the inlet chamber 48 and movable thereby against the force of the check valve spring 74 to disengage from the check valve seat 72 when the pressure in the inlet chamber 48 is below a predetermined value.

The compressor 11 is shown in a normal operaton condition in FIG. 1. The pressure in the inlet chamber 48 is below said predetermined value and the check valve element 73 is moved off the check valve seat 72 thereby establishing communicaton between the inlet port 47 and the inlet chamber 48 through the bores of the valve body 71 and the equalizing valve element 81. With the check valve element 73 in this position, the equalizing valve element 81 is positioned as shown so that the groove 81*a* aligns with only the orifices 79*a*, thereby disconnecting the equalizing passageways 78 and 79 from each other and thereby the inlet chamber 48 from the outlet passageway 52.

Figure 3:
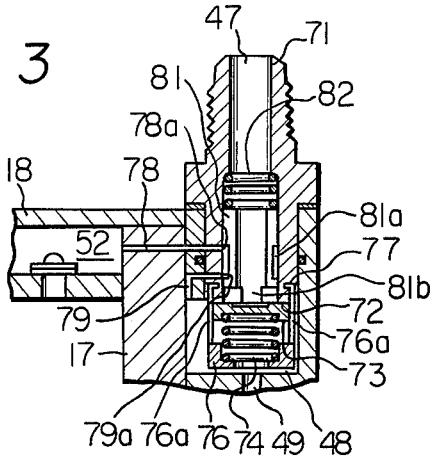
FIG. 3 is an enlarged sectional view of a valve assembly of the compressor shown in FIG. 1 with the compressor in a stopped condition.

FIG. 3 shows the compressor 11 with the rotor 28 stopped. Since the compressor 11 is not operating, suction is not produced in the inlet chamber 48 and the check valve element 73 is forced against the valve seat 72 by the check valve spring 74 thereby disconnecting the inlet chamber 48 from the inlet port 47. It will be understood that the pressure in the inlet chamber 48 is substantially atmospheric and is higher than said predetermined value.

In addition, the equalizing valve element 81 is moved upwardly along with the check valve element 73 so that the groove 81*a* aligns with both the orifices 78*a* and 79*a*. This connects the equalizing passageways 78 and 79 together and connects the outlet passageway 52 with the inlet chamber 48 therethrough. In this manner, the pressures in the outlet passageway 52, outlet chamber 56, oil sump 36 and inlet chamber 48 quickly equalize thereby preventing flow of oil after the compressor 11 is stopped. Filling of the low pressure oil chamber 27, inlet chamber 48 and bore 14 with oil and the resultant hydraulic shock upon restarting of the compressor 11 are effectively eliminated.

In summary, the present invention solves the problem of hydraulic shock upon starting a rotary compressor of the type in which lubrication is accomplished by means of a pressure difference between inlet and outlet passageways in a simple but unique manner by eliminating the cause of the shock. Many modifications to the particular embodiment shown within the scope of the invention will become possible for those skilled in the art after receiving the teachings of the present disclosure.

What is claimed is:

1. A rotary compressor comprising:

a housing formed with a bore;

a fluid inlet passageway leading to the bore and being formed with a fluid inlet port;

a fluid outlet passageway leading from the bore and being formed with a fluid outlet port;

a rotor operatively disposed in the bore in such a manner as to compressively displace fluid from the inlet passageway to the outlet passageway;

a lubricant reservoir in communicaton with the outlet passageway;

a lubricant passageway leading from the lubricant reservoir to the inlet passageway and communicating with the rotor in such a manner that lubricant is caused to flow through the lubricant passageway for lubrication of the rotor when a pressure in the outlet passageway is greater than a pressure in the inlet passageway;

a check valve provided to the inlet port and arranged to open the inlet port when the pressure in the inlet passageway is below a predetermined value and to block the inlet port when the pressure in the inlet passageway is above the predetermined value;

an equalizing passageway leading from the outlet passageway to the inlet passageway; and an equalizing valve provided in the equalizing passageway and connected for unitary operation with the check valve, the equalizing valve being arranged to block the equalizing passageway when the pressure in the inlet passageway is below the predetermined value and to open the equalizing passageway when the pressure in the inlet passageway is above the predetermined value.

2. A rotary compressor as in claim 1, in which the rotor comprises a rotor body formed with substantially radial slots and a plurality of vanes slidably mounted in the slots respectively, the lubricant passageway being partially defined by radially inner portions of the slots so that the lubricant therein urges the vanes radially outwardly into sealing engagement with an inner wall of the bore.

3. A rotary compressor as in claim 2, in which the bore and the rotor body are circular in section, the rotor being eccentrically disposed in the bore so that the rotor body is tangent to the inner wall of the bore.

4. A rotary compressor as in claim 2, in which the slots and vanes are coextensive with the rotor body.

5. A rotary compressor as in claim 2, in which the housing comprises a cylinder formed with said bore and first and second end plates formed with openings therethrough respectively, the openings communicating with said radially inner portions of the slots of the rotor body and partially defining the lubricant passageway, one of the openings communicating with the lubricant reservoir and the other of the openings communicating with the inlet passageway.

6. A rotary compressor as in claim 1, further comprising a valve body provided to the inlet portion formed with a bore for communication of the inlet port with the inlet passageway therethrough, one end of the valve body being formed with a check valve seat, the check valve including a check valve element and a check valve spring urging the check valve element into sealing engagement with the check valve seat, the check valve element being exposed to the pressure in the inlet passageway and movable thereby against the force of the check valve spring to disengage from the check valve seat, the equalizing passageway being formed with a first portion thereof leading from the outlet passageway to a first orifice opening into the valve body bore and a second portion thereof leading from a second orifice opening into the valve body bore adjacent to the first orifice to the inlet passageway, the equalizing valve comprising a bored equalizing valve element sealingly slidable in the valve body bore and being formed with a groove, the equalizing valve element being maintained in engagement with the check valve element for unitary movement therewith in such a manner that the groove aligns with the first and second orifice to communicate the first and second orifices with each other therethrough and open the equalizing passageway when the check valve element is in engagement with the check valve seat and disaligns with the first and second orifices to block the equalizing passageway when the check valve element disengages from the check valve seat.

7. A rotary compressor as in claim 6, in which the equalizing valve element is separate from the check valve element, the equalizing valve further comprising an equalizing valve spring urging the equalizing valve element into engagement with the check valve element for unitary movement.

8. A rotary compressor as in claim 7, in which the check valve spring is stronger than the equalizing valve spring.

9. A rotary compressor comprising:

a housing formed with a bore;

a fluid inlet passageway in the housing leading to the bore and being formed with a fluid inlet port;

a fluid outlet passageway in the housing leading from the bore and being formed with a fluid outlet port;

a rotor operatively disposed in the bore in such a manner as to compressively displace fluid from the inlet passageway to the outlet passageway;

a lubricant reservoir in the housing;

a passageway in the housing communicating the lubricant reservoir with the outlet passageway;

a lubricant passageway in the housing leading from the lubricant reservoir to the inlet passageway and communicating with the rotor in such a manner that lubricant is caused to flow through the lubricant passageway for lubrication of the rotor when a pressure in the outlet passageway is greater than a pressure in the inlet passageway;

a check valve in the housing provided in the inlet port and arranged to open the inlet port when the pressure in the inlet passageway is below a predetermined value and to block the inlet port when the pressure in the inlet passageway is above the predetermined valve;

an equalizing passageway in the housing leading from the outlet passageway to the inlet passageway; and an equalizing valve provided in the housing in the equalizing passageway and connected for unitary operation with the check valve, the equalizing valve being arranged to block the equalizing passageway when the pressure in the inlet passageway is below the predetermined value and to open the equalizing passageway when the pressure in the inlet passageway is above the predetermined value.

* * * * *